United States Patent [19]

Egami

[11] 4,262,713

[45] Apr. 21, 1981

[54] PROCESS FOR CHARGING AND MIXING STANDARD GAS MIXTURE

[75] Inventor: Masashi Egami, Tokyo, Japan

[73] Assignee: Takachiho Chemical Industrial Co., Ltd., Tokyo, Japan

[21] Appl. No.: 64,407

[22] Filed: Aug. 7, 1979

[30] Foreign Application Priority Data

May 1, 1979 [JP] Japan ..... 54-53696

[51] Int. Cl.[3] ..... B65B 3/04

[52] U.S. Cl. ..... 141/9; 141/171

[58] Field of Search ..... 141/1-12, 141/113, 168-176, 100-110, 238-248, 164, 163

[56] References Cited

FOREIGN PATENT DOCUMENTS 1307658 12/1961 France ..... 141/171

*Primary Examiner*—Houston S. Bell, Jr.

*Attorney, Agent, or Firm*—Walter H. Schneider

[57] ABSTRACT

Calculated amounts of an initial filler gas and a mixing gas are introduced into a vessel from its lower end while the vessel is in an inclined state. During the introduction of the gases into the vessel, it is maintained at a predetermined temperature. After charging, the vessel is inverted to effect mixing of the charged gases.

2 Claims, 2 Drawing Figures

PROCESS FOR CHARGING AND MIXING STANDARD GAS MIXTURE

The present invention relates to a process for homogeneously mixing two or more gases and easily and accurately charging the same in a vessel in the preparation of a standard gas which is used for automatic measurement required in the automatic operation of various devices or which is used as a standard in the measurement of vehicle exhaust gas, the degree of air pollution or other production gases.

In the preparation of a standard gas mixture of this type, new bottles or recovered vessels (hereinafter referred to as bombs) which have had their interiors cleaned thoroughly are kept erect with their valves positioned at the top or are inverted with their valves positioned at the bottom. The bombs are heated to about 60°-90° C., and any gas remaining in the bombs is removed completely through the valves by means of suction using a vacuum pump. Upon natural cooling, the bombs are disposed with their valves positioned at the top. If $N_2$ gas is to be mixed with such initial filler gases as NO, $NO_2$, CO, $C_3H_8$ or $CO_2$, calculated amounts of these gases are charged into the bombs whose valves are then connected to an $N_2$ tank to introduce a calculated amount of $N_2$ Gas. For example, if $CO_2$ is to be mixed with $N_2$, the mixture cannot be used until 1-2 weeks after charging if the gases are merely introduced and then left as is. Since such a method is unproductive, a bomb is immersed in warm water for a long period of time after introduction of the gases to warm the confined gases, thereby effecting homogeneous mixing. Alternatively, the bomb is reclined on a plurality of rollers rotated under motive power to tumble the bomb on its own axis, thus forcibly effect mixing.

These processes are disadvantageous in that they require the movement of heavy bombs, an increase in plant area occupied by hot water tanks for the extended period of warm water immersion, the consumption of heat sources, noise pollution due to the rotation of the bombs, environmental deterioration and consumption of power which all run counter to saving of resources.

Another serious defect is that a sample must be taken out from each bomb and tested since accuracy cannot be assured by the charging of theoretical volumes of gases because the concentration of each gas in a given volume of the gas mixture varies due to changes in gas volume which depends upon season, weather and other environmental conditions. Alternatively, the flow rates of the gases to be mixed must be controlled with expensive meters.

The present invention is directed toward eliminating the above defects. To this end, the present invention provides a process wherein a bomb maintained in an inclined attitude is charged from its lower end with an initial filler gas and a mixing gas, the bomb being kept at a constant temperature with a very small quantity of flowing liquid such as groundwater at least during charging, after which the inclination of the bomb is inverted to effect excellent mixing of the gases.

The process of the present invention will be now be described with reference to the accompanying drawings illustrating an embodiment of a device for practicing the invention.

Figure 1:
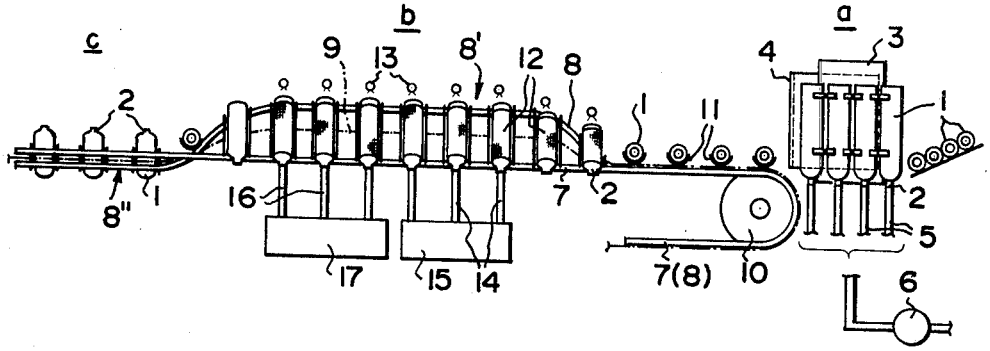
FIG. 1 shows travelling state of the bombs.

If a recovered bomb is to be re-used, the bomb must first be cleaned by discharging any gas remaining in the bomb, though this will be unnecessary if a new bomb is to be used. A device is used which consists roughly of three parts: a part a for the cleaning treatment of the bomb, a charging part b for introducing gases into the bomb kept at a constant temperature, and a mixing part c for accelerating the mixing of the charged gases. In an example of a bomb treatment part a, a bomb 1 is kept in an inverted attitude with a valve 2 positioned at the bottom thereof. A bomb-supporting cylinder 3 rotates intermittently or slowly, and a heater 4 is provided around the cylinder. The bombs 1 are supported by the cylinder 3 with their valves placed at the bottom and are heated to about 60°-90° C. by the heater 4. During the operation, the gas remaining in the bomb 1 is expanded and forcibly withdrawn by a vacuum pump 6 via a flexible pipe 5 connected with the valve 2 to thoroughly clean the inside of the bomb 1.

Guide rails 7 and 8 are provided adjacent to the bomb-treatment part a. Though the guide rails are placed on a perpendicular plane in the embodiment shown in the figure, it is preferred to place them in an endless manner on a horizontal plane. One of the guide rails 7 and 8 (guide rail 8 in this case) has a protrusion 8' beyond the other guide rail 7 in the charging part b and a depression 8'' in the mixing part c. As a matter of course, when one of the guide rails (i.e. guide rail 8) is horizontally positioned, the other guide rail 7 forms a depression in the charging part b and a protrusion in the mixing part c. Both rails 7 and 8 may also form depressions and protrusions.

Nearly at the center of the guide rails 7 and 8, a travelling belt 9 such as a chain is provided and forms an endless belt with a pulley 10. Mounting bodies 11 for bombs 1 are provided at a proper pitch on the travelling belt 9. The mounting bodies which support the bombs 1 so that the bombs 1 do not slip down are supported on the guide rails 7 and 8 and are guided thereby, whereby they travel intermittently or slowly as pulley 10 rotates.

Figure 2:
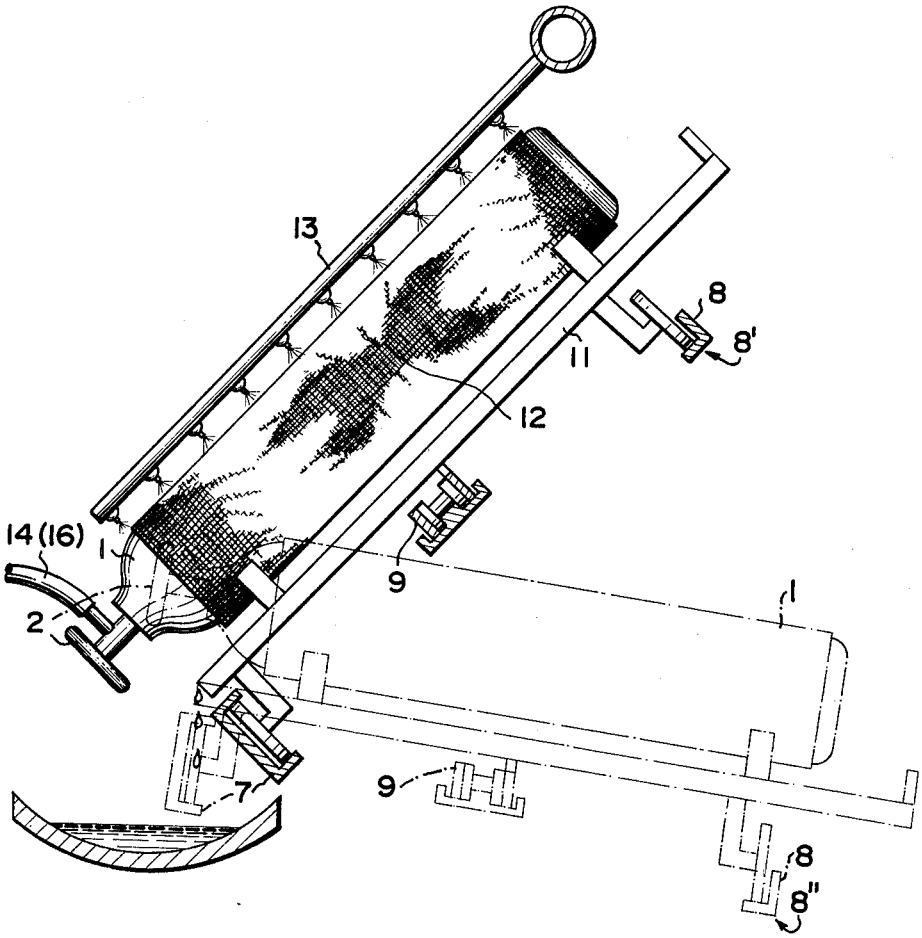
FIG. 2 is a side view showing the sprinkling of water.

The flexible pipes 5 are removed from the empty bombs 1 thus treated. The bombs 1 are laid on the mounting bodies 11, and are advanced to the protrusion 8' of guide rails 7 and 8 as the travelling belt 9 moves. Then, the mounting bodies 11 are inclined as shown in FIG. 2. Therefore, the inclined bombs 1 are also moved with the valves 2 positioned at the bottom thereof.

During this operation, each bomb 1 is covered with a water-absorbing sheet 12 (preferably a sheet having a rough tissue structure such as a gauze sheet). A water-sprinkling pipe 13 is provided in the protrusion 8' to sprinkle water over the water-absorbing sheet 12. Though water which remains substantially at a constant temperature during a year such as groundwater is most economical, water regulated to a constant temperature may of course be used.

When groundwater is thus sprinkled on the bomb 1 heated by the bomb treatment, the bomb 1 is cooled rapidly due to radiation of heat which accompanies the evaporation of water from the sheet 12. This is aided by heat dissipation due to a large amount of evaporation and by promoting evaporation by means of an air draft. The bomb is kept at a constant temperature equal to that of the water economically throughout the year.

In the charging part b in which the bomb 1 is kept inclined with the valve 2 placed at the bottom thereof at a constant temperature, an initial charging gas such as $CO_2$, NO, $NO_2$, CO or $C_3H_8$ is introduced in the bomb 1 from a gas reservoir 15 through a flexible pipe 14 connected to the valve 2. When the pressure calculated from the volume of the reservoir has been attained, the introduction of gas is stopped by closing the valve 2. Then, the flexible pipe 14 is replaced with a flexible pipe 16 for introducing a mixing gas. A mixing gas such as $N_2$ is introduced from a tank 17 through the flexible pipe 16 connected to the valve 2 until the pressure calculated from a volume thereof has been attained as described above. Upon introducing the gas, valve 2 of bomb 1 is closed. Then, the water-absorbing sheet 12 is removed therefrom while the bomb is moved into the mixing part c.

In the mixing part c, the rail 8 forms a depression 8'' which is lower than the rail 8. Hence, the bomb 1 advances for a suitable period of time with its valve 2 positioned at the top, that is, in an attitude which is opposite to that in the charging part 2 where the valve is positioned at the bottom.

This operation of inverting the bomb 1 effects the refluxing and mixing of the charged gases.

The order of charging the gases in the above process is not particularly limited. However, it is preferred from viewpoint of operation to charge a gas which is used in a small amount first and then a gas used in a larger amount. Further, it is most preferred to charge gases in an order of from a lower specific heat gradually to a higher specific heat.

According to the process of the present invention, the amount of water consumed is reduced to about 1/10 by using the water-absorbing sheet 12. Further, concentration of the charged gases is always kept constant since the bomb is kept at a constant temperature during charging. Therefore, charging can be effected in the easiest manner and gas volume is very accurate. Consequently, it is possible to readily obtain a standard gas mixture exhibiting an accurate mixing ratio and of a uniform quality. The invention allows the operation to be carried out in the same manner without effecting any alteration throughout the year. In addition, a quality measurement step for each bomb which has been inevitable according to the conventional processes can be omitted. Thus, simplification and improvement in efficiency can be expected.

An embodiment of the present invention wherein a gas mixture of $CO_2+N_2$ is charged in a bomb will be given below.

An empty bomb was heated to about 70° C. for 60 minutes in the bomb treatment part a while any gas remaining therein is drawn out with the vacuum pump 6.

The bomb thus treated was inverted at an angle of about 45° and covered with a sheet of water-absorbing gauze 12. Groundwater immediately after drawing was sprinkled onto the gauze at a rate of about 2.0 liters/bomb/min. 10–20 minutes had passed, the bomb was kept at a temperature of about 15° C. When the initial temperature of the bomb was high, the groundwater was first applied thereto dropwise at a rate of about 0.2 liter/bomb/min. while air was directed toward the bomb with a fan to lower the bomb temperature rapidly. The groundwater was then applied thereto at a rate of about 2.0 liters/bomb/min. to effect the charging of the gas while the temperature was kept constant.

15.500 Volume % of $CO_2$ was charged in the bombs kept at the constant temperature, and then 84.500 volume % of $N_2$ was charged therein. When the bombs were taken out (about 5 minutes later), samples were taken out from five bombs and subjected to tests to obtain results of 15.50, 15.49, 15.50, 15.51 and 15.50. The results indicate that the resulting mixture was homogeneous and that mixing ratio was accurate.

What is claimed is:

1. In a process for charging gases into a vessel and causing the same to mix into a standard gas mixture to be used for measurement, the improvement comprising the steps of charging calculated amounts of an initial filler gas and then a mixing gas into a treated vessel maintained at a predetermined temperature, the charging of the mixing gas being made through the lower opening of the vessel while the vessel is maintained in an inclined state at least at the time that the mixing gas is introduced, and subsequently inverting the vessel to promote the mixing of the gases.

2. In a process for charging and mixing a standard gas mixture to be used for measurement, the improvement comprising charging calculated amounts of an initial filler gas and a mixing gas into a treated vessel maintained at a predetermined temperature, said temperature being maintained constant by covering the vessel with a water-absorbing sheet and supplying the sheet with a liquid at a constant temperature such as ground water and, if necessary, accelerating the rate at which the vessel attains the constant temperature by using an air draft to dissipate the heat generated by evaporation of the water, introducing the gases through the lower opening of the vessel while it is maintained in an inclined state at least at the time that the mixing gas is introduced, and subsequently inverting the inclined vessel to effect the mixing of the gases.

* * * * *